US006330817B1

(12) United States Patent
Frolov

(10) Patent No.: US 6,330,817 B1
(45) Date of Patent: Dec. 18, 2001

(54) ANTI-JAM LOCKING MECHANISM FOR ELECTRONIC SECURITY SYSTEM

(75) Inventor: George Frolov, Farmington, CT (US)

(73) Assignee: Harrow Products, Inc., Woodcliff Lake, NJ (US)

( * ) Notice: Subject to any disclaimer, the term of this patent is extended or adjusted under 35 U.S.C. 154(b) by 0 days.

(21) Appl. No.: 09/495,497

(22) Filed: Feb. 1, 2000

(51) Int. Cl.[7] ..... E05B 47/00
(52) U.S. Cl. ..... 70/280; 70/277; 292/144
(58) Field of Search ..... 70/277, 280–282; 292/144

(56) References Cited

U.S. PATENT DOCUMENTS 4,917,419 * 4/1990 Mora, Jr. et al. ..... 70/279.1 X
5,018,375 * 5/1991 Tully ..... 70/472
5,083,122 1/1992 Clark ..... 340/825.32
5,608,298 3/1997 Frolov et al. ..... 318/286
5,628,216 * 5/1997 Qureshi et al. ..... 70/278.7
5,640,863 6/1997 Frolov ..... 70/283
6,076,870 * 6/2000 Frolov ..... 292/144 X

* cited by examiner

*Primary Examiner*—Lloyd A. Gall
(74) *Attorney, Agent, or Firm*—Alix, Yale & Ristas, LLP

(57) ABSTRACT

A locking mechanism for engaging a strike includes a frame having a receptacle configured to receive the strike and a locking pin reciprocally mounted to the frame for reciprocating between a retracted position and an extended position. The locking pin is configured for mating with the strike when the locking pin is disposed in the extended position. A drive link extends from the locking pin and a motor is provided for driving a drive shaft. A spring shaft has one end engageable with the drive shaft. A coupling is disposed between a second end of the spring shaft and the frame. The drive link is configured to engage individual coil surfaces of the spring shaft during rotation thereof to drive the locking pin towards the retracted or extended position.

20 Claims, 2 Drawing Sheets

ANTI-JAM LOCKING MECHANISM FOR ELECTRONIC SECURITY SYSTEM

BACKGROUND OF THE INVENTION

The present invention relates generally to security systems and, more particularly, relates to locking mechanisms for controlling access to various areas of a facility.

Securing various areas of a facility such as a school or university requires a relatively complex system. For example, the facilities of a university may be spread across a number of buildings each of which may include laboratories and cabinets, etc. to which various individuals may be authorized access. In order to manage this access, sophisticated security systems now may include an electronic control system such as a computer. The computer may include software to authorize general access to various groups of individuals or specific access to individuals themselves. For example, for general access to a particular building, laboratory or cabinet within a building, the computer may remotely control locking mechanisms for the locking and unlocking of doors at particular times during a day. Specific access may be granted to a particular individual via a remote access system such as a key pad, card reader or the like located adjacent the building, laboratory or cabinet to be entered.

One locking mechanism to which the invention relates is described in U.S. Pat. No. 5,640,863 to Frolov issued Jun. 24, 1997 and assigned to the present assignee hereof and entitled "Clutch Mechanism For Door Lock System." This patent discloses an electronic lock control mechanism which is integrated with the lockset of a door.

A need has arisen for providing low cost, reliable and durable locking mechanism responsive to the electronic control system or computer system discussed above which may be mounted outside of the lockset of a door and/or a cabinet. The locking mechanism should also be capable of avoiding jamming such as may occur when the locking mechanism is actuated prior to full closure of the door or cabinet.

SUMMARY OF THE INVENTION

Briefly stated, the invention in a preferred form is a locking mechanism which includes a frame and a locking pin reciprocally mounted to the frame for reciprocating between a retracted position and an extended position. The locking pin is configured for mating with the strike when the locking pin is disposed in the extended position. A drive link or drive pin extends from the locking pin, and a motor is provided for driving a drive shaft. A spring shaft has a first end and a second end wherein the first end is engageable with the drive shaft and a novel coupling is disposed between the second end of the spring shaft and the frame. The drive pin is configured to engage individual coil surfaces of the spring shaft during rotation thereof whereby the drive link is resiliently urged by the spring shaft towards the retracted or extended position.

In accordance with the invention, the coupling may comprise a slide interconnected with the second end of the spring shaft. The slide is configured to move in response to tension or compression occurring in the spring shaft when jammed and to prevent disengagement of the drive pin from the spring shaft. A bearing may be interposed between the slide and the frame to provide for linear and rotational movement of the slide. The slide comprises a spool with a pair of end stops having a greater diameter than that of the spool surface. The locking pin has a longitudinal axis. The drive pin extends in a perpendicular direction from that of the longitudinal axis of the locking pin. The drive pin may comprise a reduced end which is dimensioned to fit between individual coils of the spring shaft. The locking pin may comprise a slot and the drive pin is mounted therein. The strike includes an aperture. The locking pin is accordingly dimensioned to pass through the aperture. The receptacle may comprise a slot defined by a wall which may include a tapered portion. The motor may comprise a micromotor and the locking mechanism further comprises a computer system for controlling operation of the motor. During movement of the locking pin towards the extended position the spring shaft may compress due to jamming resulting from failure of the locking pin to properly mate with the strike.

In another aspect of the invention, a locking mechanism is provided for engaging a strike. The locking mechanism includes a frame having a receptacle configured to receive the strike. An operator is mounted to the frame such that the operator may move at least between a retracted position and an extended position. The operator is configured for engaging the strike when the operator is disposed in the extended position. A motor is provided for driving a drive shaft and a spring shaft has a first end and a second end where the first end is engageable with the drive shaft. A coupling disposed between the second end of the spring shaft and the frame comprises a slide interconnected with the second end of the spring shaft. The slide is sufficiently spaced from the opposing end of the spring shaft to allow compression and a return under tension and is configured to slide in response to tension or compression occurring in the spring shaft. The operator is configured to engage individual coil faces of the spring shaft during rotation thereof whereby the operator is resiliently urged by the spring shaft towards the extended or retracted position. In this manner, the operator cannot disengage from the spring shaft.

In a further aspect of the invention, an integrated system comprises a plurality of locking mechanisms as described above and further comprises a computer system for controlling operation of each of the locking mechanisms via actuation of each of the motors. The computer system establishes various groups and subgroups of locking mechanisms, certain members of which may be further controlled individually via remote access devices and others of which may be controlled solely by the computer system. For example, the computer system may actuate particular locking mechanisms depending upon time of day.

An object of the invention is to provide a new and improved automatic locking mechanism for use on cabinets and the like and having a relatively low cost and efficient construction.

Another object of the invention is to provide a locking mechanism which may be efficiently employed in conjunction with an electronic control system.

A further object of the invention is to provide a locking mechanism which is operational even when jamming conditions are experienced between the strike and associated lock component pin.

A yet further object of the invention is to provide a reliable locking mechanism which has less susceptibility to mechanical failure and is not defeated by jamming conditions.

Other objects and advantages of the invention will become apparent from the drawings and the specification.

DETAILED DESCRIPTION OF THE PREFERRED EMBODIMENT

Figure 1:
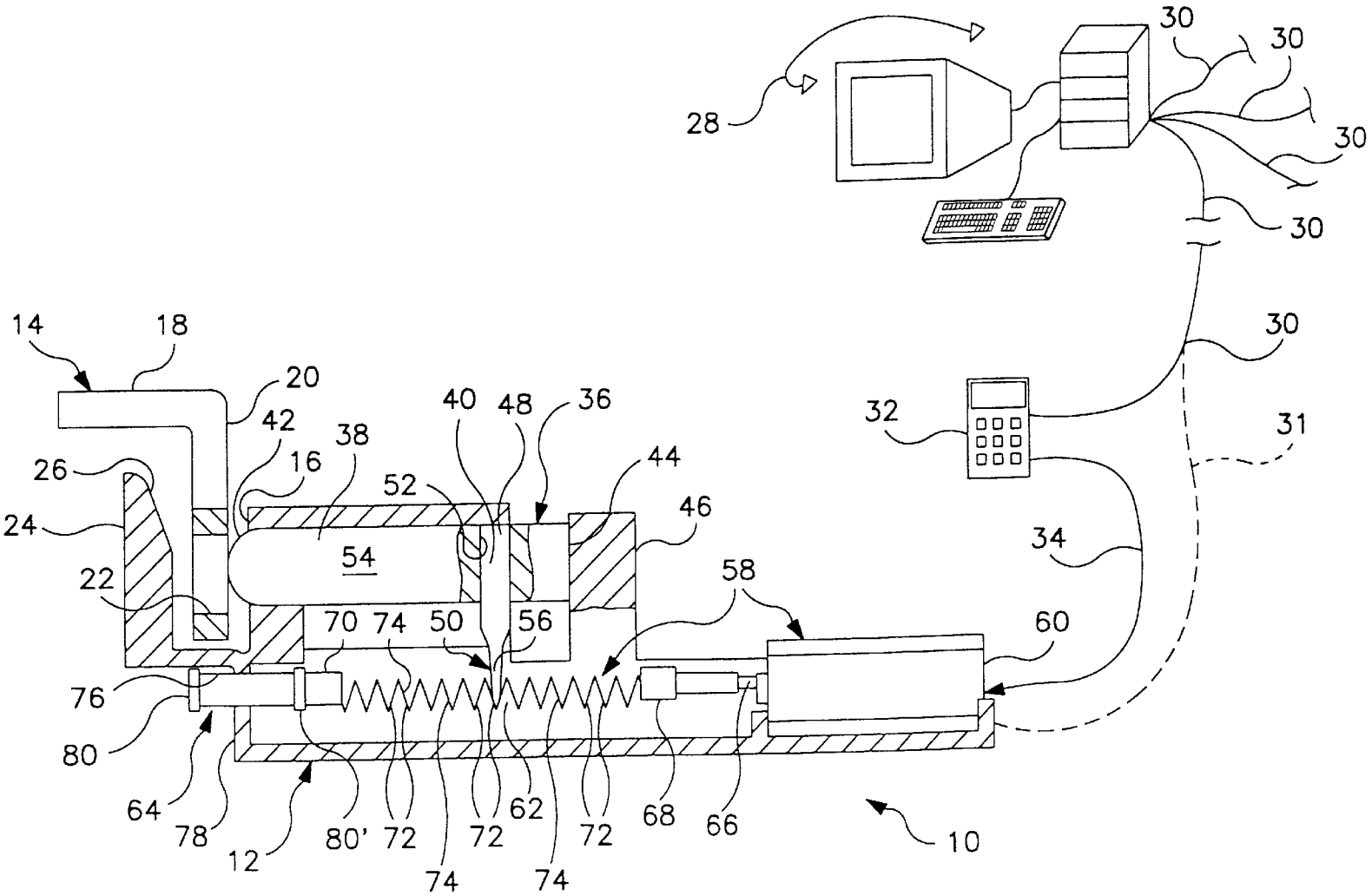
FIG. 1 is a side sectional view, partly broken away, of a locking mechanism and a strike wherein a locking pin is disposed in a retracted position and a schematic view of an associated electronic control system in accordance with an embodiment of the present invention.

A locking mechanism in accordance with an embodiment of the present invention is illustrated generally at 10 in FIG. 1. The locking mechanism 10 employs a frame 12 and an associated strike 14 which are separately mounted to doors or cabinets (neither shown), e.g., by suitable fasteners (also not shown) with one mounted on a door and the other mounted on a door frame or one mounted on a cabinet door and the other mounted on the cabinet frame. The locking mechanism 10, which in the described preferred embodiment is a cabinet lock, is particularly adapted for incorporating into an electronic security system.

The frame 12 provides structure for supporting and mounting the components of the locking mechanism 10 and thus may be composed of any suitably strong and durable material such as aluminum or steel. The frame also includes a receptacle or slot 16 for receipt of a strike such as strike 14.

The strike 14 may be composed of a hardened steel having high strength and durability suitable for locking systems. The strike 14 includes a mounting portion 18 and a catch portion 20. The catch portion 20 includes an aperture 22, and the catch is dimensioned to fit within the slot 16 of the frame 12. The locking mechanism 10 may be employed with numerous strike configurations and types of strikes.

The slot 16 is defined by a wall 24 which includes a tapered portion 26. The tapered portion 26 provides an entry way for the strike 14 and is shaped to accommodate alignment differences caused by drift from settling, hinge wear, warpage, etc.

Operation of the locking mechanism 10 may be controlled by an electronic control system such as a computer system 28 which may comprise programming software for controlling one or more locking mechanisms 10. In particular, the locking mechanism 10 may be part of an integrated security system located at a university where control over the opening of doors in various buildings and/or a particular lab and/or cabinets within a particular building may be accomplished via communication lines 30. Communication between the computer system 28 and the locking mechanism 10 may also be accomplished through electromagnetic radiation rather than through communication lines 30. It will also be appreciated that the number of locking mechanisms 10 which may be controlled by the computer system 28 will be dependent upon the particular application and, thus, it will be understood that four communication lines 30 are shown for illustrational purposes only.

The computer system 28 may actuate various locking systems based upon, for example, time of day, for providing general access and/or may provide individual access based upon a remote access device such as a user input device 32 e.g., a card reader or a key pad.

In the case where general access is to be provided, the computer system 28 may communicate directly with the locking device 10 via line 31 and thereby omit the user input device 32. For example, in a school where several cabinets are unlocked at a certain time and locked at another time, such user input may not be necessary or desirable. As illustrated, in the application where access is provided on an individual basis, the output of the user input device 32 may, for example, extend to the locking mechanism 10 via cable 34. One electronically controlled locking system is described in U.S. Pat. No. 5,083,122, assigned to the assignee hereof, and hereby incorporated herein by reference.

Figure 2:
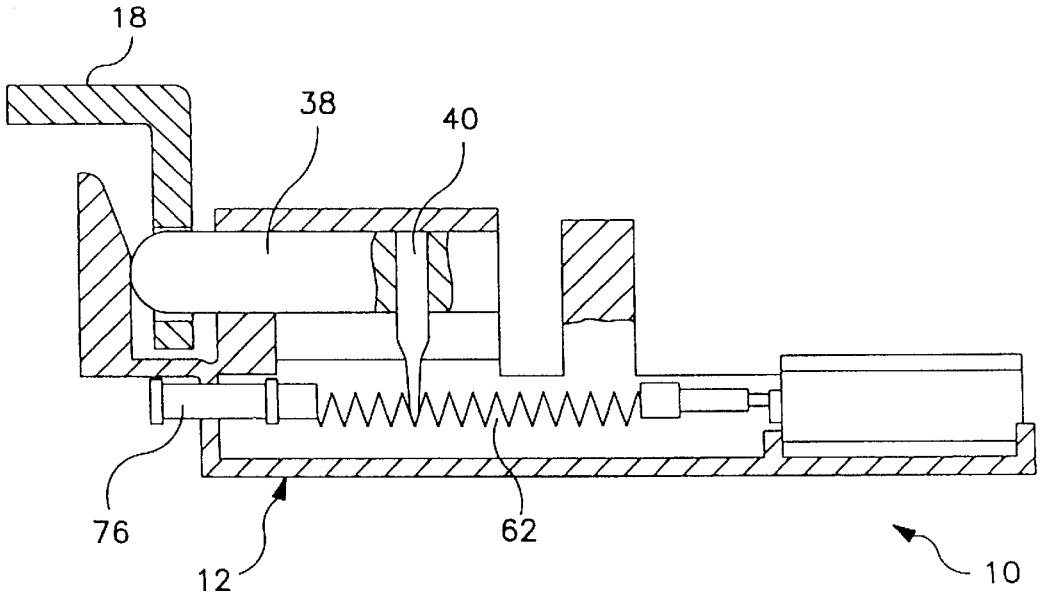
FIG. 2 is a sectional view illustrating the locking mechanism and strike wherein the locking pin is disposed in an extended position.

In accordance with the present invention, an operator 36 is mounted within the frame 12 such that it may be reciprocated from a retracted position, as illustrated in FIG. 1, to an extended position, e.g., abutting the wall 24, as illustrated in FIG. 2. Although the frame 12 is not shown in its entirety in any of the Figures, it will be understood that the frame may be an assembly which is structured in a known manner to support linear movement of the operator 36 and may comprise at least one bushing or other suitable bearings (not shown).

The operator 36 comprises a locking pin 38 and a drive link or drive pin 40. The locking pin 38 is preferably formed of a hardened steel and is preferably cylindrical in shape and is dimensioned to fit within the aperture 22 of the strike 14. The locking pin 38 comprises a rounded head 42 for easing insertion into the aperture 22, in the event that both the locking pin 38 and aperture 22 are slightly out of alignment during mating thereof. The locking pin 38 also includes a flat end 44 which engages a stop 46 of the frame 12.

The drive pin 40 is also preferably formed of a hardened steel and is cylindrical in shape. The drive pin 40 includes a shank 48 and a reduced distal end 50. The shank 48 is illustrated as being disposed within a slot 52 of the pin 38 and, e.g., may be pressed in place. Optionally, it will be appreciated that the shank 48 may be simply welded to an outer surface 54 of the pin 38 or molded therewith.

The end 50 is appropriately dimensioned and configured to receive a force for movement of the locking pin 38 between the retracted and extended positions as will be more fully described below.

In accordance with a feature of the present invention a resilient auger assembly 58 is provided for resiliently urging the locking pin 38 into the retracted and extended positions. The auger assembly 58 comprises a motor 60, a spring shaft 62 and a coupling assembly 64. The motor 60 preferably comprises a direct current micro-motor, such as Mabuchi™ Part No. P/N FF-050SH-11190 of Mabuchi Motor Co., Ltd. of Matsudo-shi, Chiba-ken, Japan.

Operation of the motor 60 is preferably controlled by an electronic control system such as by the computer system 28 discussed above. The motor 60 receives input via cable 34 which may or may not include motive power. Optionally, the motor 60 may be powered by its own power source such as a battery (not shown) and accept a control code via cable 34. The motor 60 also comprises a drive shaft 66.

In accordance with another feature of the present invention, the spring shaft 62 comprises a coil spring which is attached at one end to the motor shaft 66 and at the other end to the coupling assembly 64 by means of epoxy or connectors 68,70. The coil spring may be composed of any suitably strong and durable material such as stainless steel. One preferred spring has six close wound coils at each end and nineteen active coils having a diameter of approximately 0.15 ins. and an uncompressed length of approximately 1.80 ins. In this regard the length of the spring, and hence the lock mechanism, may be axially compact since the drive pin will not disengage from the other end of the spring due to the coupling assembly 64.

The end 50 of the drive pin 40 is dimensioned to fit between the individual coils 72 of the spring shaft 62, thereby engaging individual coil surfaces 74. The coil surfaces 74 urge the drive pin 40 in a linear direction during rotation of the spring shaft 62. Thus, the drive pin 40 travels along the coil surfaces 74 until the motor 60 is de-energized.

In accordance with a further feature of the present invention, the coupling assembly 64 comprises a slide 76 which is preferably a spool with end stops 80, and 80' which is received for reciprocation in a bearing 78. The spool 76 may be composed of any suitably strong material, such as a plastic, and functions to slide in a longitudinal direction depending on the compression or tension of the spring shaft 62 which will be more fully discussed below.

The spool 76 may also rotate within the bearing 78 during the period when the motor 60 is energized. The end stops 80,80' are provided for limiting the amount of distance which the slide 64 may travel.

Figure 3:
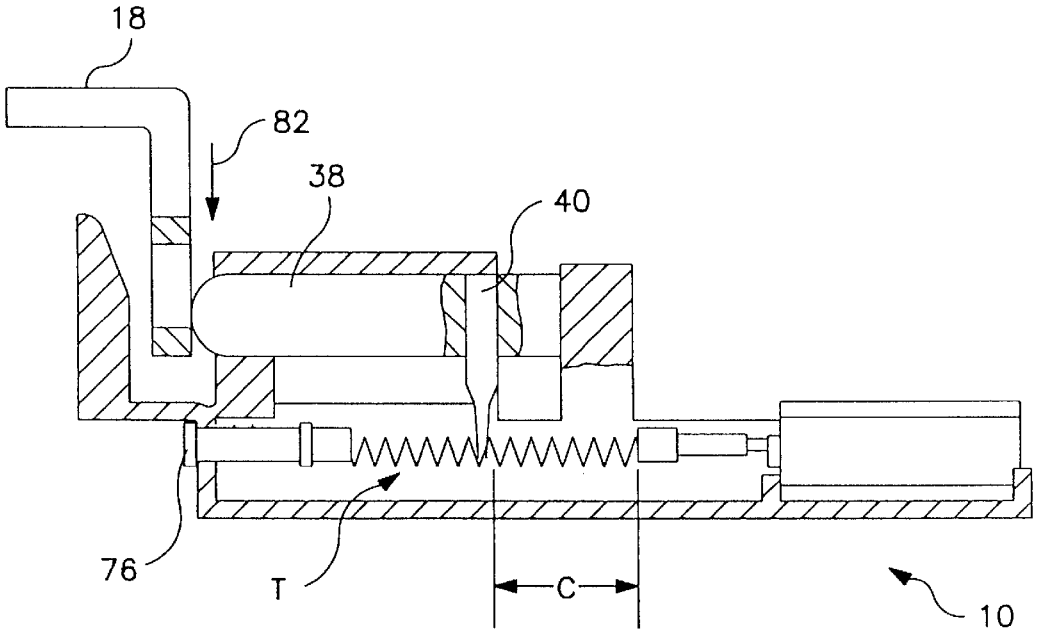
FIG. 3 is a sectional view similar to that of FIG. 1 illustrating the locking mechanism and strike in a jammed condition.

In operation, when the motor 60 is energized, the spring shaft 62 will urge the drive pin 40 in a linear direction thereby moving locking pin 38 towards the extended position which is illustrated in FIG. 2. However, referring also to FIG. 3, if the strike 14 is not completely disposed within the slot 16, the locking pin will be prevented from moving to the fully extended position. In such a case the motor 60 will continue to rotate the motor shaft 66 and compression of the spring shaft 62 will occur. Compression of the spring shaft 62 is illustrated over the portion of the spring shaft labeled "C". Due to the compression of a portion of the spring shaft "C", the rest of the spring shaft will be in tension, labeled "T". Because of this tension, the spool 76 will axially slide towards the tension of the spring, allowing further individual coils 72 to compress until the motor stops rotating. Without the limiting stops 80,80' or other limiting structures, the drive pin 40 could disengage from the spring shaft 62 and would not necessarily reengage thereby effectively rendering the device inoperative. When the jam condition is removed, the spring shaft 62 functions by means of the compressed coils as a memory mechanism to drive the drive pin 40 to the proper position. Thus, in this position, the locking pin 38 is resiliently urged against the strike 14, and should movement of the strike 14 occur in the direction of arrow 82, then the locking pin will be able to slide into or through the aperture 22, thereby locking the strike into place. The spool 76 ordinarily would not appreciably axially slide in non-jam conditions. It should be appreciated that the strike may be configured in numerous ways that permit the locking pin to interact with the strike to perform a locking function.

While the present invention has been described in connection with what is presently considered to be the most practical and preferred embodiments, it is to be understood that the present invention is not limited to the disclosed embodiments. Rather, it is intended to cover all of the various modifications and equivalent arrangements included within the spirit and scope of the appended claims.

What is claimed is:

1. A locking mechanism comprising:

a frame assembly;

a locking pin mounted to said frame assembly for reciprocating between a retracted position and an extended position;

a drive link extending from said locking pin;

a motor for rotatably driving a drive shaft;

a spring shaft having a first end and a second end, the first end being engageable with said drive shaft;

a coupling connecting the second end of said spring shaft and said frame assembly; and wherein said drive link is configured to engage individual coil surfaces of said spring shaft during rotation thereof whereby said locking pin is resiliently urged towards the retracted or extended position.

2. The locking mechanism of claim 1, wherein said coupling comprises a slide interconnected with said second end of said spring shaft, said slide being configured to move in response to tension or compression occurring in said spring shaft.

3. The locking mechanism of claim 2 further comprises a bearing interposed between said slide and said frame assembly, said bearing providing for linear and rotational movement of said slide.

4. The locking mechanism of claim 3 wherein said slide comprises a spool having a pair of end stops.

5. The locking mechanism of claim 1 wherein:

said locking pin defines a longitudinal axis;

said drive link extends in a perpendicular direction to that of the longitudinal axis of said locking pin; and said drive link comprises a reduced end which is dimensioned to fit between individual coils of said spring shaft.

6. The locking mechanism of claim 5 wherein:

the locking pin comprises a slot and the drive link is mounted therein; and a strike is provided for engaging with said locking pin, said strike includes an aperture and said locking pin is dimensioned to engage the aperture.

7. The locking mechanism of claim 6 wherein said frame assembly further comprises a receptacle, said receptacle being at least partially defined by a wall and said wall having a tapered portion.

8. The locking mechanism of claim 1 wherein said motor comprises a micromotor and further comprising a computer system for controlling operation of said motor.

9. The locking mechanism of claim 1 wherein during movement of said locking pin towards the extended position, said spring shaft compresses upon failure of the locking pin to properly mate with a strike.

10. A locking mechanism for engaging a strike, the locking mechanism comprising:

a frame having a receptacle configured to receive the strike;

an operator mounted to said frame such that said operator may move at least between a retracted position and an extended position, said operator being configured for engaging the strike when the operator is disposed in the extended position;

a motor for driving a drive shaft;

a spring shaft having a first end and an axially spaced second end, the first end being engageable with said drive shaft; and a coupling rotatably mounting the second end of said spring shaft relative to said frame, said coupling comprising a slide interconnected with said second end of said spring shaft, said slide being configured to axially move in response to tension or compression in said spring shaft;

wherein said operator is configured to engage individual coil faces of said spring shaft during rotation thereof whereby said operator is resiliently urged by said spring shaft towards the extended or retracted position.

11. The locking mechanism of claim 10 wherein said operator comprises:

a locking pin reciprocally mounted to said frame for reciprocating between the retracted position and the extended position, said locking pin being configured for mating with the strike when the locking pin is disposed in the extended position; and a driver fixedly connected to said locking pin.

12. The locking mechanism of claim 11 wherein:

said locking pin has a longitudinal axis;

said driver extends in a perpendicular direction to that of the longitudinal axis of said locking pin; and said driver is dimensioned and positionable to fit between individual coils of said spring shaft.

13. The locking mechanism of claim 12 wherein said pin comprises a reduced end.

14. The locking mechanism of claim 12 wherein:

the locking pin comprises a slot and the driver is mounted therein; and the strike includes an aperture and said locking pin is dimensioned for reception in the aperture.

15. The locking mechanism of claim 10 further comprising a bearing being interposed between said slide and said frame, said bearing permitting at least one of linear or rotational movement of said slide.

16. The locking mechanism of claim 15 wherein said slide comprises a spool having a pair of end stops.

17. The locking mechanism of claim 10 wherein said receptacle is at least partially defined by a wall and said wall includes a tapered portion.

18. A system comprising a plurality of locking mechanisms as defined by claim 10 and further comprising:

a computer system for controlling operation of each of the locking mechanisms via selective actuation of each of said motors, said computer system establishing selectively definable groups of locking mechanisms, one group of locking mechanisms being further controllable individually via remote access devices and a second group locking mechanisms is controllable solely by the computer system.

19. The system of claim 18 wherein the computer system actuates particular locking mechanisms depending upon time of day.

20. A locking mechanism for engaging a strike, the locking mechanism comprising:

frame means configured to receive the strike;

locking means mounted to said frame means for reciprocating between a retracted position and an extended position, said locking means being configured for mating with the strike when the locking means is disposed in the extended position;

drive means for linearly driving said locking means;

a motor for driving a drive shaft;

a spring shaft having a first end and an axially spaced second end, the first end being engageable with said drive shaft; and coupling means for coupling the second end of said spring shaft to permit limited axial movement of said second end;

wherein said drive means is configured to engage individual coil faces of said spring shaft during rotation thereof whereby said locking means is resiliently urged by said spring shaft toward the extended or retracted position.

* * * * *